US006893895B1

(12) United States Patent
Okoroanyanwu et al.

(10) Patent No.: US 6,893,895 B1
(45) Date of Patent: May 17, 2005

(54) CUS FORMATION BY ANODIC SULFIDE PASSIVATION OF COPPER SURFACE

(75) Inventors: Uzodinma Okoroanyanwu, Mountain View, CA (US); Sergey D. Lopatin, Santa Clara, CA (US); Matthew S. Buynoski, Palo Alto, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 10/885,944

(22) Filed: Jul. 7, 2004

(51) Int. Cl.[7] ..... H01L 51/40
(52) U.S. Cl. ..... 438/99
(58) Field of Search ..... 438/800, 687, 438/624, 622, 618, 99, 780; 257/13; 205/578, 576, 332, 317, 139, 96, 77

(56) References Cited

U.S. PATENT DOCUMENTS 6,656,763 B1 * 12/2003 Oglesby et al. ..... 438/99
6,683,002 B1 * 1/2004 Chooi et al. ..... 438/687
6,686,263 B1 2/2004 Lopatin et al.
6,746,971 B1 6/2004 Ngo et al.
6,753,247 B1 6/2004 Okoroanyanwu et al.

* cited by examiner

*Primary Examiner*—David Zarneke
*Assistant Examiner*—Monica D. Harrison
(74) *Attorney, Agent, or Firm*—Amin & Turocy, LLP

(57) ABSTRACT

Disclosed are methods of making memory cells and semiconductor devices containing the memory cells. The methods involve passivating a portion of a copper containing electrode to form a copper sulfide layer in an electrochemical cell by applying a current through a passivation solution containing a sulfide compound. Such devices containing the memory cells are characterized by light weight and robust reliability.

20 Claims, 2 Drawing Sheets

CUS FORMATION BY ANODIC SULFIDE PASSIVATION OF COPPER SURFACE

TECHNICAL FIELD

The present invention generally relates to using a passivation treatment to form passive layers in organic memory devices. In particular, the present invention relates to CuS passive layers formed by a sulfide passivation treatment in memory devices containing an organic semiconductor.

BACKGROUND ART

The basic functions of a computer and memory devices include information processing and storage. In typical computer systems, these arithmetic, logic, and memory operations are performed by devices that are capable of reversibly switching between two states often referred to as "0" and "1." Such switching devices are fabricated from semiconducting devices that perform these various functions and are capable of switching between two states at high speed.

Electronic addressing or logic devices, for instance for storage or processing of data, are made with inorganic solid state technology, and particularly crystalline silicon devices. The metal oxide semiconductor field effect transistor (MOSFET) is one the main workhorses. Much of the progress in making computers and memory devices faster, smaller and cheaper involves integration, squeezing ever more transistors and other electronic structures onto a postage-stamp-sized piece of silicon. A postage-stamp-sized piece of silicon may contain tens of millions of transistors, each transistor as small as a few hundred nanometers. However, silicon-based devices are approaching their fundamental physical size limits.

Inorganic solid state devices are generally encumbered with a complex architecture which leads to high cost and a loss of data storage density. The circuitry of volatile semiconductor memories based on inorganic semiconductor material must constantly be supplied with electric current with a resulting heating and high electric power consumption in order to maintain stored information. Non-volatile semiconductor devices have a reduced data rate and relatively high power consumption and large degree of complexity.

Moreover, as inorganic solid state device sizes decrease and integration increases, sensitivity to alignment tolerances increases making fabrication markedly more difficult. Formation of features at small minimum sizes does not imply that the minimum size can be used for fabrication of working circuits. It is necessary to have alignment tolerances which are much smaller than the small minimum size, for example, one quarter the minimum size.

SUMMARY OF THE INVENTION

The following is a summary of the invention in order to provide a basic understanding of some aspects of the invention. This summary is not intended to identify key/critical elements of the invention or to delineate the scope of the invention. Its sole purpose is to present some concepts of the invention in a simplified form as a prelude to the more detailed description that is presented later.

The present invention provides organic memory devices containing organic memory cells having a CuS layer formed by a sulfide passivation treatment of a copper containing surface, such as a copper containing electrode. Consequently, the thickness of the CuS layer is relatively uniform, small, and controllable, compared with forming CuS layers by other methods. The use of dangerous compounds to form a CuS layer, such as $H_2S$ gas, is mitigated and/or eliminated. Moreover, since the CuS layer may be formed within an electrode, delamination concerns are mitigated.

The organic memory devices containing the organic memory cells having a CuS layer possess one or more of the following: small size compared to inorganic memory devices, capability to store multiple bits of information, short resistance/impedance switch time, low operating voltages, low cost, high reliability, long life (thousands/millions of cycles), capable of three dimensional packing, associated low temperature processing, light weight, high density/integration, and extended memory retention.

One aspect of the invention relates to a method of making a memory cell involving providing a partially fabricated memory structure containing a patterned dielectric over a first electrode, charging the partially fabricated memory structure into an electrochemical cell containing a cathode and a passivation solution containing a sulfide compound, applying a current density through the electrochemical cell so that a CuS layer is formed on the first electrode, forming an organic semiconductor over the CuS layer, and forming a second electrode over the organic semiconductor. The electrode of the partially fabricated memory structure serves as the anode in the electrochemical cell.

Another aspect of the present invention relates to a method of making a CuS layer in a memory cell involving providing an electrochemical cell containing a cathode, a partially fabricated memory structure with a patterned dielectric over an electrode, and a passivation solution containing a sulfide compound, and applying a current to the electrochemical cell so that sulfide ions are generated in the passivation solution and migrate to the electrode surface to react with copper and form the CuS layer. Again, the electrode of the partially fabricated memory structure serves as the anode in the electrochemical cell.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DISCLOSURE OF THE INVENTION

The present invention involves using a sulfide passivation treatment to form CuS layers or regions in organic memory cells made of two electrodes with a controllably conductive media between the two electrodes. The controllably conductive media contains an organic semiconductor layer and the CuS layer, the latter formed by the sulfide passivation treatment of a copper containing electrode. Specifically, copper in an electrode reacts with sulfide ions that electrodeposit on the electrode surface, thereby forming copper sulfide. The organic memory cells may optionally contain additional layers, such as additional electrodes, charge retention layers, and/or chemically active layers.

The impedance of the controllably conductive media changes when an external stimulus such as an applied electric field is imposed. A plurality of organic memory cells, which may be referred to as an array, form an organic memory device. In this connection, organic memory cells may form an organic memory device and function in a manner analogous to metal oxide semiconductor field effect transistors (MOSFETs) in conventional semiconductor memory devices. However, there are advantages to using the organic memory cells instead of conventional MOSFETs in memory devices.

It is noted that the term CuS layer or region refers to a portion of a memory element or memory cell that contains $Cu_xS_y$, as a conductivity facilitating compound, where x and y are independently from about 0.5 to about 4. In another embodiment, x and y are independently from about 0.75 to about 3. Common examples of $Cu_xS_y$ compounds include $CuS_2$, $Cu_2S_3$, CuS, $Cu_{1.5}S$, $Cu_2S$, $Cu_{2.5}S$, $Cu_3S$, and the like. For simplicity and brevity, all such copper sulfide layers falling within the noted $Cu_xS_y$ formula are generically referred to as CuS layers.

Figure 1:
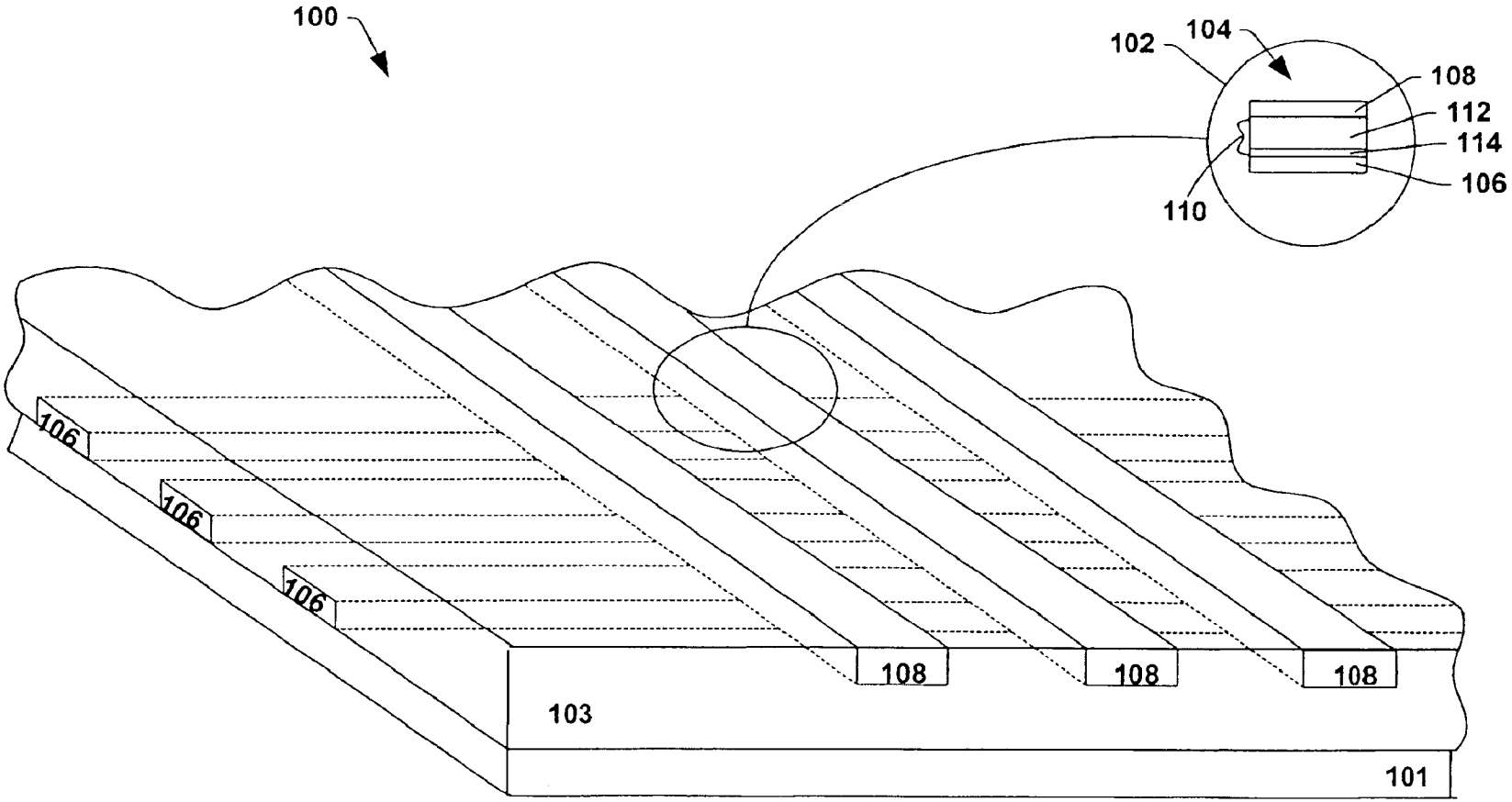
FIG. 1 illustrates a perspective view of a microelectronic device containing a plurality of organic memory cells in accordance with one aspect of the invention.

Referring to FIG. 1, a brief description of a microelectronic organic memory device 100 containing a plurality of organic memory cells in accordance with one aspect of the invention is shown, as well as an exploded view 102 of an exemplary organic memory cell 104. The microelectronic organic memory device 100 contains a desired number of organic memory cells, as determined by the number of rows, columns, and layers (three dimensional orientation described later) present. The organic memory cells are formed in a dielectric 103, which is formed over a substrate 101. The first electrodes 106 and the second electrodes 108 are shown in substantially perpendicular orientation, although other orientations are possible to achieve the structure of the exploded view 102. Each organic memory cell 104 contains a first electrode 106 containing copper and a second electrode 108 with a controllably conductive media 110 therebetween. The controllably conductive media 110 contains an organic semiconductor layer 112 and CuS layer 114 that is formed by sulfide passivation techniques. Peripheral circuitry and devices are not shown for brevity. The dielectric 103 may contain a polymer dielectric such as BCB, polyimide, and the like, a silicon based dielectric such as silicon dioxide or silicon nitride, or a non-silicon inorganic dielectric.

The organic memory cells contain at least two electrodes, as one or more electrodes may be disposed between the two electrodes that sandwich the controllably conductive media. The electrodes are made of conductive material, such as conductive metal, conductive metal alloys, conductive metal oxides, conductive polymer films, semiconductive materials, and the like. However, the electrode that is adjacent the CuS layer contains at least copper, so as to permit formation of a CuS layer by a sulfide passivation treatment. In one embodiment, the electrode that is adjacent the CuS layer contains at least 50% by weight copper.

Examples of materials for the electrode that is not adjacent the CuS layer include one or more of aluminum, chromium, copper, germanium, gold, magnesium, manganese, indium, iron, nickel, palladium, platinum, silver, titanium, zinc, and alloys thereof, indium-tin oxide (ITO); polysilicon; doped amorphous silicon; metal silicides; and the like. Alloy electrodes specifically include Hastelloy®, Kovar®, Invar, Monel®, Inconel®, brass, stainless steel, magnesium-silver alloy, and various other alloys. One or more of these materials may be present in combination with copper in the electrode that is adjacent the CuS layer.

In one embodiment, the thickness of each electrode is independently about 0.01 $\mu$m or more and about 10 $\mu$m or less. In another embodiment, the thickness of each electrode is independently about 0.05 $\mu$m or more and about 5 $\mu$m or less. In yet another embodiment, the thickness of each electrode is independently about 0.1 $\mu$m or more and about 1 $\mu$m or less.

Active devices of organic semiconductor devices and polymer memory devices contain an organic semiconductor and a CuS layer, which together can constitute a controllably conductive media. The controllably conductive media can be rendered conductive or non-conductive in a controllable manner using an external stimuli. Generally, in the absence of an external stimuli, the controllably conductive media is non-conductive or has a high impedance. Further, in some embodiments, multiple degrees of conductivity/resistivity may be established for the controllably conductive media in a controllable manner. For example, the multiple degrees of conductivity/resistivity for the controllably conductive media may include a non-conductive state, a highly conductive state, a semiconductive state, and resistive state(s) with various levels of resistance (in other words, the controllably conductive media may have a plurality of conductive states).

The controllably conductive media can be rendered conductive, non-conductive or any state therebetween (degree of conductivity) in a controllable manner by an external stimulus (external meaning originating from outside the controllably conductive media). For example, under an external electric field, radiation, and the like, a given non-conductive controllably conductive media is converted to a conductive controllably conductive media.

The controllably conductive media contains one or more organic semiconductor layers and one or more CuS layers. The CuS of the CuS layer acts a conductivity facilitating compound in conjunction with the organic semiconductor layers. In one embodiment, the controllably conductive media contains at least one organic semiconductor layer that is adjacent a CuS layer (without any intermediary layers between the organic semiconductor layer and CuS layer).

Examples of conductivity facilitating compounds include one or more of the above mentioned $Cu_xS_y$ compounds such as $CuS_2$, $Cu_2S_3$, CuS, $Cu_{1.5}S$, $Cu_2S$, $Cu_{2.5}S$, $Cu_3S$, and the like. The conductivity facilitating compounds do not necessarily dissociate into ions under the strength of the electric field, although ions may move through them. The CuS layer may contain two or more subCuS layers, each sublayer containing the same, different, or multiple conductivity facilitating compounds.

The CuS layer is formed on/within an electrode that contains copper. Generally speaking, the CuS layer is formed using sulfide passivation techniques. The electrode containing copper is passivated with sulfide ions so that a relatively thin copper sulfide layer is formed thereover/therein.

The electrode containing copper may optionally contain a copper seed layer thereon. The copper seed layer in some instances facilitates the formation of a CuS layer by passivation techniques. In one embodiment, the copper seed layer has a thickness of about 1 Å or more and about 100 Å or less. In another embodiment, the copper seed layer has a thickness of about 5 Å or more and about 50 Å or less. In embodiments where a copper seed layer is employed, the electrode does not need to contain copper below the copper seed layer, although copper is often contained within the electrode.

The passivation solution contains a liquid such as water and a suitable amount of a sulfide compound to generate enough sulfide ions that passivate the copper containing electrode surface. The liquid may alternatively or further contain a polar organic solvent, such as a lower alcohol. In one embodiment, the passivation solution contains from about 0.1% to about 40% by weight of a sulfide compound. In another embodiment, the passivation solution contains from about 0.5% to about 30% by weight of a sulfide compound. In yet another embodiment, the passivation solution contains from about 1% to about 20% by weight of a sulfide compound.

General examples of sulfide compounds include organic sulfide compounds and inorganic sulfide compounds. Specific examples of sulfide compounds include ammonium sulfide, alkylammonium sulfides such as tetramethylammonium sulfide, dimethylsulfide, benzylmethylsulfide, sodium sulfide, lithium sulfide, and the like.

Optionally, the passivation solution contains a reducing agent. The reducing agent is a species which reduces something else (and is itself oxidized in the process). That is, the reducing agent facilitates the formation of sulfide ions in the passivation solution and/or facilitates the formation of CuS at the electrode surface. Examples of reducing agents include hydrogen, certain metals (depending upon the specific components of a given passivation solution), an acid, a base, carbon, and hydrocarbons. In one embodiment, the passivation solution contains from about 0.01% to about 10% by weight of a reducing agent. In another embodiment, the passivation solution contains from about 0.05% to about 5% by weight of a reducing agent.

The temperature of the passivation solution is typically from about 10° C. to about 100° C. In one embodiment, the temperature is from about 20° C. to about 80° C. In another embodiment, the temperature is from about 25° C. to about 60° C. The temperature is maintained to maximize the conversion of Cu and sulfide ions to CuS, while not substantially damaging or degrading the underlying electrode.

Any suitable source of power is connected to the electrochemical cell containing the passivation solution, such as direct current, alternating current, pulsed current, periodic reverse current, or combinations thereof. Specifically, the power source is connected to a cathode and the electrode containing copper (as the anode). A current density is imposed from an energy source through the electrodes causing sulfide ions from the passivation solution to migrate towards and attach/react with the electrode thereby forming a CuS layer. In one embodiment, current densities of about 1 ASF or more and about 500 ASF or less are employed. In another embodiment, current densities of about 2 ASF or more and about 100 ASF or less are employed. In yet another embodiment, current densities of about 5 ASF or more and about 50 ASF or less are employed.

The length of time that the partially fabricated memory structure/electrode is in contact with the passivation solution under a specified current density depends upon the desired thickness of the resultant CuS layer and the concentrations of the passivation solution components. In one embodiment, the partially fabricated memory structure/electrode is in contact with the passivation solution under a specified current density for a time of about 1 second or longer and about 120 minutes or shorter. In another embodiment, the partially fabricated memory structure/electrode is in contact with the passivation solution under a specified current density for a time of about 5 seconds or longer and about 30 minutes or shorter. In yet another embodiment, the partially fabricated memory structure/electrode is in contact with the passivation solution under a specified current density for a time of about 10 seconds or longer and about 10 minutes or shorter.

In some instances, to promote long charge retention times (in the organic semiconductor layer), the CuS layer may be treated with a plasma after it is formed. The plasma treatment modifies the energy barrier of the CuS layer. In one embodiment, the CuS layer is formed without using $H_2S$. This can be advantageous since $H_2S$ is a poisonous substance, the use of which is disfavored.

In one embodiment, the CuS layer containing the conductivity facilitating compound formed via passivation techniques in accordance with the present invention has a thickness of about 2 Å or more and about 0.1 $\mu$m or less. In another embodiment, the CuS layer has a thickness of about 10 Å or more and about 0.1 $\mu$m or less. In yet another embodiment, the CuS layer has a thickness of about 50 Å or more and about 0.005 $\mu$m or less.

A covalent bond may be formed between the organic semiconductor material and the CuS layer. Alternatively, close contact is required to provide good charge carrier/electron exchange between the organic semiconductor layer and the CuS layer. The organic semiconductor layer and the CuS layer are electrically coupled in that charge carrier/electron exchange occurs between the two layers.

Organic semiconductors thus have a carbon based structure, often a carbon—hydrogen based structure, which is different from conventional MOSFETs. In this connection, the organic semiconductor layer, such as a conjugated organic polymer, has the ability to donate and accept charges (holes and/or electrons). Generally, the organic semiconductor or an atom/moiety in the polymer has at least two relatively stable states. The two relatively stable oxidation states permit the organic semiconductor to donate and accept charges and electrically interact with the conductivity facilitating compound. The ability of the organic semiconductor layer to donate and accept charges and electrically interact with the passive layer also depends on the identity of the conductivity facilitating compound.

Organic semiconductors generally include polymers with variable electric conductivity. In one embodiment, the organic semiconductor contains a conjugated organic polymer. In another embodiment, the organic semiconductor contains a conjugated organic polymer with an aromatic group within its repeating unit. The polymer backbone of the conjugated organic polymer extends lengthwise between the electrodes. The conjugated organic polymer may be linear or branched, so long as the polymer retains its conjugated nature.

In yet another embodiment, the organic semiconductor contains an organometallic polymer (such as a conjugated organometallic polymer), or carbon structures such as carbon nanotubes and buckyballs. A carbon nanotube is typically a hexagonal network of carbon atoms that is rolled up into a seamless cylinder. Each end may be capped with half of a fullerene molecule. Carbon nanotubes may be prepared by the laser vaporization of a carbon target (a cobalt-nickel catalyst may facilitate growth) or a carbon-arc method to grow similar arrays of single-wall nanotubes. A buckyball is more specifically a buckminster-fullerene, a soccerball-shaped 60-atom or 70-atom cluster of pure carbon.

Examples of polymers with variable electrical conductivity include polyacetylene; polydiphenylacetylene; poly(t-butyl)diphenylacetylene; poly(trifluoromethyl)diphenyl acetylene; polybis(tri fluoromethyl)acetylene; polybis(t-butyldiphenyl)acetylene; poly(trimethylsilyl) diphenylacetylene; poly(carbazole)diphenyl acetylene; polydiacetylene; polyphenyl acetylene; polypyridineacetylene; polymethoxyphenylacetylene; polymethylphenyl acetylene; poly(t-butyl)phenylacetylene; polynitro-phenylacetylene; poly(trifluoromethyl) phenylacetylene; poly(trimethylsilyl) pheylacetylene; polydipyrryl methane; polyindoqiunone; polydihydroxyindole; polytrihydroxyindole; furane-polydihydroxyindole; polyindoqiunone-2-carboxyl; polyindoqiunone; polybenzobisthiazole; poly(p-phenylene sulfide); polyaniline; polythiophene; polypyrrole; polysilane; polystyrene; polyfuran; polyindole; polyazulene; polyphenylene; polypyridine; polybipyridine; polyphthalocyanine; polysexithiofene; poly (siliconoxohemiporphyrazine); poly (germaniumoxoliemiporphyrazine); poly (ethylenedioxythiophene); polymetallocene complexes (Fe, V, Cr, Co, Ni and the like); polypyridine metal complexes (Ru, Os and the like); and the like.

In one embodiment, the organic semiconductor layer is not doped with a salt. In another embodiment, the organic semiconductor layer is doped with a salt. A salt is an ionic compound having an anion and cation. General examples of salts that can be employed to dope the organic semiconductor layer include alkaline earth metal halogens, sulfates, persulfates, nitrates, phosphates, and the like; alkali metal halogens, sulfates, persulfates, nitrates, phosphates, and the like; transition metal halogens, sulfates, persulfates, nitrates, phosphates, and the like; ammonium halogens, sulfates, persulfates, nitrates, phosphates, and the like; quaternary alkyl ammonium halogens, sulfates, persulfates, nitrates, phosphates, and the like.

In one embodiment, the organic semiconductor layer has a thickness of about 0.001 $\mu$m or more and about 5 $\mu$m or less. In another embodiment, the organic semiconductor layer has a thickness of about 0.01 $\mu$m or more and about 2.5 $\mu$m or less. In yet another embodiment, the organic semiconductor layer has a thickness of about 0.05 $\mu$m or more and about 1 $\mu$m or less.

The organic semiconductor layer may be formed by spin-on techniques (depositing a mixture of the polymer/polymer precursor and a solvent, then removing the solvent from the substrate/electrode), by chemical vapor deposition (CVD) optionally including a gas reaction, gas phase deposition, and the like. CVD includes low pressure chemical vapor deposition (LPCVD), plasma enhanced chemical vapor deposition (PECVD), and high density chemical vapor deposition (HDCVD). During formation or deposition, the organic semiconductor material self assembles between the electrodes. It is not typically necessary to functionalize one or more ends of the organic polymer in order to attach it to an electrode/CuS layer.

The CuS layer may in some instances act as a catalyst when forming the organic semiconductor layer, particularly when the organic semiconductor layer contains a conjugated organic polymer. In this connection, the polymer backbone of the conjugated organic polymer may initially form adjacent the CuS layer, and grow or assemble away and substantially perpendicular to the CuS layer surface. As a result, the polymer backbones of the organic polymers may be self aligned in a direction that traverses the electrodes or in a direction away from the CuS layer.

Figure 2:
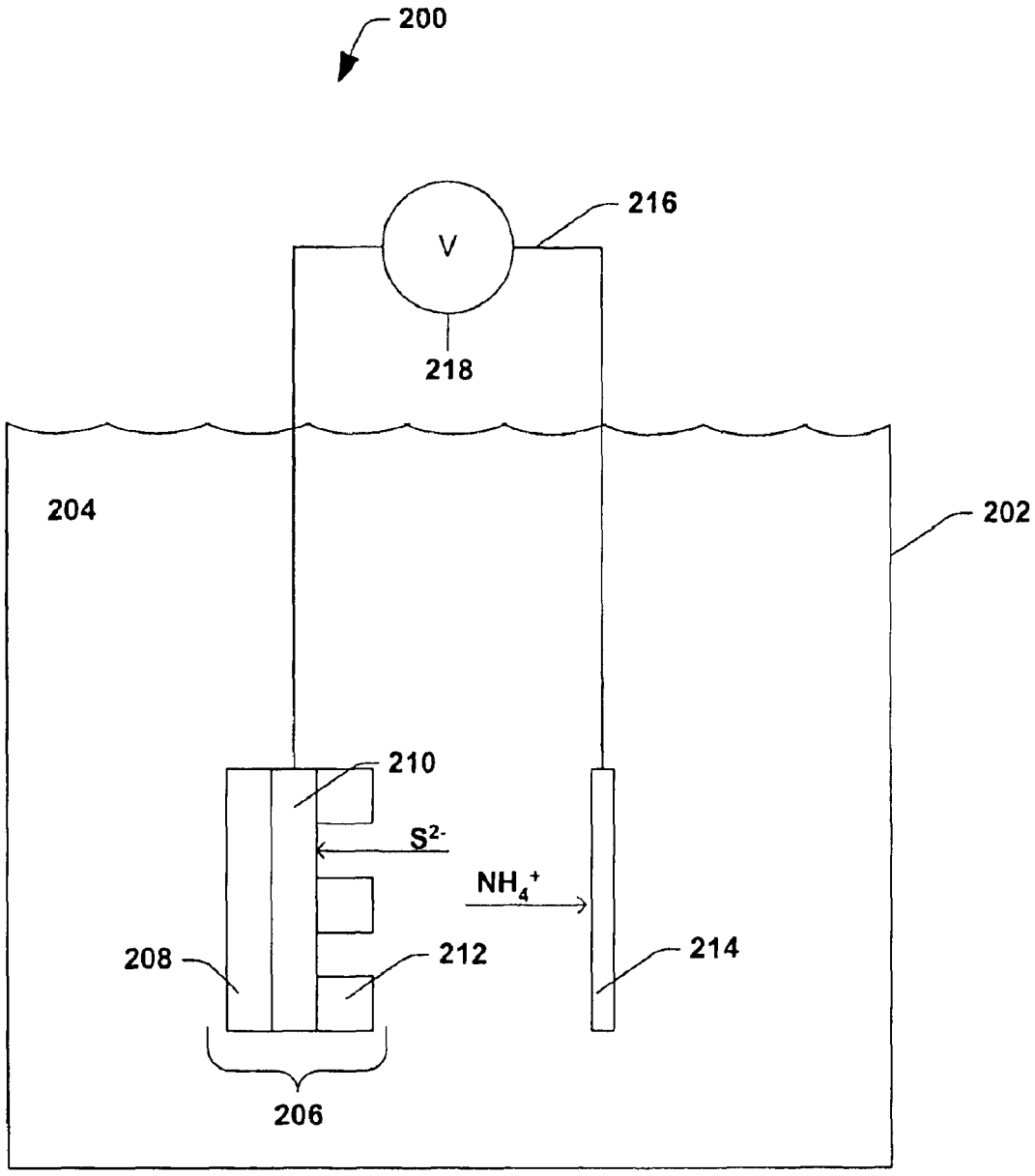
FIG. 2 illustrates a cross sectional view of a method of forming a passive layer in an organic memory cell in accordance with another aspect of the invention.

Referring to FIG. 2, a system 200 for forming a passive layer in a memory cell in accordance with the present invention is described. The system 200 includes a electrochemical cell 202 or electrochemical bath that is at least partially filled with a passivation solution 204. In this case, the passivation solution 212 contains an aqueous ammonium sulfide solution. A partially fabricated memory structure 206 is positioned in the passivation solution 204.

The partially fabricated memory structure 206 contains a substrate 208, an electrode 210 containing at least copper, and a patterned dielectric material 212. The patterned dielectric material 212 is patterned so that the passive layer is formed in the exposed regions of the electrode 210 (through the openings in the patterned dielectric material 212). The patterned dielectric material 212 is non-conductive and can contain a polymer dielectric, a resist material, or an inorganic dielectric.

A cathode 214 is also positioned in the passivation solution 212. The cathode 214 contains one or more metals such as platinum, palladium, titanium, silver, and the like. Both the cathode 214 and the partially fabricated memory structure 206 are electrically connected 216 to a voltage source 218. The electrode 210 the partially fabricated memory structure 206 functions as the anode in the electrochemical cell 202. The voltage source 218 serves to apply a current to the electrochemical cell 202 and drive the passivation of the exposed portions of the electrode 210. Upon application of current, as shown by the relevant arrow sulfide ions migrate to the electrode 210 surface and react with copper contained in the electrode 210 and form a CuS passive layer in the exposed regions of the electrode 210. As shown by the other relevant arrow, ammonium ions migrate to the cathode upon application of current through the electrochemical cell 202.

Although not shown in FIG. 2, after the passive layer is formed, a polymer is deposited over structure 206 and specifically into the opening in the patterned dielectric material 212, where it forms an organic semiconductor. In some instances, the thin film of CuS facilitates the orderly growth and alignment of the organic polymer in position normal to the surface of the film of CuS. A second electrode is then formed over the organic semiconductor to complete the fabrication of a memory cell.

A CuS layer contains at least one conductivity facilitating compound that contributes to the controllably conductive properties of the controllably conductive media. The conductivity facilitating compound has the ability to donate and accept charges (holes and/or electrons) and/or act as a source of copper ions. The CuS layer thus may transport holes, electrons, and/or ions between an electrode and the organic polymer layer/CuS layer interface, facilitate charge/carrier injection into the organic polymer layer, and/or increase the concentration of a charge carrier (ions, holes and/or electrons) in the organic polymer layer. In some instances, the CuS layer may store opposite charges thereby providing a balance of charges in the organic memory device as a whole. Storing charges/charge carriers is facilitated by the existence of two relatively stable oxidation states for the conductivity facilitating compound.

The Fermi level of the CuS layer is close to the valence band of the organic semiconductor layer. Consequently, the injected charge carrier (into the organic semiconductor layer) may recombine with the charge at the CuS layer if the energy band of the charged organic semiconductor layer does not substantially change. Positioning energy bands involves compromising between ease of charge injection and length of charge (data) retention time.

The applied external field can reduce the energy barrier between the CuS layer and organic layer depending on the field direction. Therefore, enhanced charge injection in the forward direction field in programming operation and also enhanced charge recombination in reversed field in erase operation can be obtained.

Operation of the organic memory devices/cells is facilitated using an external stimuli to achieve a switching effect. The external stimuli include an external electric field and/or light radiation. Under various conditions, the organic memory cell is either conductive (low impedance or "on" state) or non-conductive (high impedance or "off" state).

The organic memory cell may further have more than one conductive or low impedance state, such as a very highly conductive state (very low impedance state), a highly conductive state (low impedance state), a conductive state (medium level impedance state), and a non-conductive state (high impedance state) thereby enabling the storage of multiple bits of information in a single organic memory cell, such as 2 or more bits of information or 4 or more bits of information.

Switching the organic memory cell to the "on" state from the "off" stale occurs when an external stimuli such as an applied electric field exceeds a threshold value. Switching the organic memory cell to the "off" state from the "on" state occurs when an external stimuli does not exceed a threshold value or does not exist. The threshold value varies depending upon a number of factor including the identity of the materials that constitute the organic memory cell and the passive layer, the thickness of the various layers, and the like.

Generally speaking, the presence of an external stimuli such as an applied electric field that exceeds a threshold value ("programming" state) permits an applied voltage to write or erase information into/from the organic memory cell and the presence of an external stimuli such as an applied electric field that is less than a threshold value permits an applied voltage to read information from the organic memory cell; whereas external stimuli that do not exceed a threshold value do not write or erase information into/from the organic memory cell.

To write information into the organic memory cell, a voltage or pulse signal that exceeds the threshold is applied. To read information written into the organic memory cell, a voltage or electric field of any polarity is applied. Measuring the impedance determines whether the organic memory cell is in a low impedance state or a high impedance state (and thus whether it is "on" or "off"). To erase information written into the organic memory cell, a negative voltage opposite in polarity to the writing signal, that exceeds a threshold value, is applied.

Examples of active devices of organic semiconductor devices and polymer memory devices include nonvolatile organic memory cells, organic semiconductor transistors, polymer semiconductor transistors, nonvolatile polymer memory cells, programmable organic memory cells, and the like. Generally, these active devices contain an organic semiconductor between two electrodes, or an organic semiconductor surrounded by three electrodes. The integrated circuit chips described herein can be employed with logic devices such as central processing units (CPUs); as volatile memory devices such as DRAM devices, as SRAM devices, and the like; with input/output devices (I/O chips); and as non-volatile memory devices such as EEPROMs, EPROMs, PROMs, and the like.

The organic semiconductor devices are useful in any device requiring memory. For example, the organic semiconductor devices are useful in computers, appliances, industrial equipment, hand-held devices, telecommunications equipment, medical equipment, research and development equipment, transportation vehicles, radar/satellite devices, and the like. Hand-held devices, and particularly hand-held electronic devices, achieve improvements in portability due to the small size and light weight of the organic memory devices. Examples of hand-held devices include cell phones and other two way communication devices, personal data assistants, pagers, notebook computers, remote controls, recorders (video and audio), radios, small televisions and web viewers, cameras, and the like.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including any reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A method of making a memory cell, comprising:

providing a partially fabricated memory structure comprising a patterned dielectric over a first electrode comprising at least copper;

charging the partially fabricated memory structure into an electrochemical cell comprising a cathode and a passivation solution comprising a sulfide compound, the sulfide compound comprising at least one selected from the group consisting of ammonium sulfide, an alkylammonium sulfide, dimethylsulfide, benzylmethylsulfide, sodium sulfide, and lithium sulfide;

applying a current density through the electrochemical cell so that a CuS layer is formed on the first electrode in portions not covered by the patterned dielectric;

forming an organic semiconductor over the CuS layer; and forming a second electrode over the organic semiconductor.

2. The method of claim 1, wherein the passivation solution comprises from about 0.1% to about 40% by weight of the sulfide compound.

3. The method of claim 1, wherein the passivation solution has a temperature from about 10° C. to about 100° C.

4. The method of claim 1, wherein the current density applied is about 1 ASF or more and about 500 ASF or less for a time of about 1 second or longer and about 120 minutes or shorter.

5. The method of claim 1, wherein the passivation solution comprises ammonium sulfide.

6. The method of claim 1, wherein the CuS layer has a thickness of about 2 Å or more and about 0.1 μm or less.

7. The method of claim 1, wherein the CuS layer comprises at least one compound represented by the formula $Cu_xS_y$, where x and y are independently from about 0.5 to about 4.

8. The method of claim 1, wherein the CuS layer is treated with a plasma before forming the organic semiconductor over the CuS layer.

9. The method of claim 1, wherein the organic semiconductor comprises at least one selected from the group consisting of polyacetylene; polydiphenylacetylene;

poly(t-butyl)diphenylacetylene; poly(trifluoromethyl) diphenylacetylene;

polybis(trifluoromethyl)acetylene; polybis(t-butyldiphenyl)acetylene; poly(trimethylsilyl) diphenylacetylene; poly(carbazole)diphenylacetylene; polydiacetylene; polyphenylacetylene; polypyridineacetylene; polymethoxyphenylacetylene; polymethylphenylacetylene; poly(t-butyl) phenylacetylene; polynitro-phenylacetylene; poly (trifluoromethyl) phenylacetylene; poly(trimethylsilyl) pheylacetylene; polydipyrrylmethane; polyindoqiunone; polydihydroxyindole; polytrihydroxyindole; furane-polydihydroxyindole; polyindoqiunone-2-carboxyl; polyindoqiunone; polybenzobisthiazole; poly(p-phenylene sulfide); polyaniline; polythiophene; polypyrrole; polysilane; polystyrene; polyfuran; polyindole; polyazulene; polyphenylene; polypyridine; polybipyridine; polyphthalocyanine; polysexithiofene; poly (siliconoxohemiporphyrazine); poly (germaniumoxohemiporphyrazine); poly (ethylenedioxythiophene); polymetallocene complexes; and polypyridine metal complexes.

10. A method of making a CuS layer in a memory cell, comprising:

providing an electrochemical cell comprising a cathode, a partially fabricated memory structure comprising a patterned dielectric over an electrode comprising at least copper, and a passivation solution comprising a sulfide compound; and applying a current density of about 1 ASF or more and about 500 ASF or less for a time of about 1 second or longer and about 120 minutes or shorter to the electrochemical cell whereby sulfide ions are generated in the passivation solution and migrate to the electrode to form the CuS layer.

11. The method of claim 10, wherein the sulfide compound is selected from the group consisting of ammonium sulfide, an alkylammonium sulfide, dimethylsulfide, benzylmethylsulfide, sodium sulfide, and lithium sulfide.

12. The method of claim 10, wherein the CuS layer has a thickness of about 10 Å or more and about 0.01 μm or less.

13. The method of claim 10, wherein the passivation solution has a temperature from about 20° C. to about 80° C.

14. The method of claim 10, wherein the current density applied is about 2 ASF or more and about 100 ASF or less for a time of about 5 seconds or longer and about 30 minutes or shorter.

15. The method of claim 10, wherein the passivation solution further comprises a reducing agent.

16. The method of claim 10, wherein the electrode comprises a copper seed layer thereon having a thickness of about 1 Å or more and about 100 Å or less.

17. A method of making a memory cell, comprising:

providing a first electrode comprising at least 50% by weight copper on a memory substrate;

patterning a dielectric over the first electrode so that portions of the first electrode remain exposed, thereby forming a memory structure;

charging the memory structure into an electrochemical cell comprising a passivation solution, and a cathode, the passivation solution comprising a sulfide compound and a reducing agent;

applying a current density through the electrochemical cell so that a CuS layer is formed on the exposed portions of the first electrode;

forming an organic semiconductor over the CuS layer; and forming a second electrode over the organic semiconductor.

18. The method of claim 17, wherein the passivation solution comprises an inorganic sulfide compound.

19. The method of claim 17, wherein the passivation solution comprises from about 0.5% to about 30% by weight of the sulfide compound.

20. The method of claim 17, with the proviso that the first electrode is not contacted with $H_2S$.

* * * * *